US007737640B2

(12) United States Patent
Marques et al.

(10) Patent No.: US 7,737,640 B2
(45) Date of Patent: Jun. 15, 2010

(54) EMERGENCY LIGHTING SYSTEM

(75) Inventors: Antonio Marques, Covington, GA (US); Richard Perry Abernethy, Alpharetta, GA (US); Jason Edward Duckworth, Houston, TX (US)

(73) Assignee: ABL IP Holding LLC, Conyers, GA (US)

( * ) Notice: Subject to any disclaimer, the term of this patent is extended or adjusted under 35 U.S.C. 154(b) by 292 days.

(21) Appl. No.: 12/025,120

(22) Filed: Feb. 4, 2008

(65) Prior Publication Data

US 2008/0191628 A1 Aug. 14, 2008

Related U.S. Application Data

(60) Provisional application No. 60/889,450, filed on Feb. 12, 2007.

(51) Int. Cl.
*H05B 37/00* (2006.01)

(52) U.S. Cl. ..... 315/86; 315/160; 315/161; 315/362

(58) Field of Classification Search ..... 315/86–87, 315/127–129, 136, 160, 161, 209 R, 291, 315/360, 362
See application file for complete search history.

(56) References Cited

U.S. PATENT DOCUMENTS

| | | | | |
|---|---|---|---|---|
| 5,015,919 | A * | 5/1991 | Vila-Masot et al. | 315/86 |
| 5,986,407 | A * | 11/1999 | Chang | 315/86 |
| 6,049,178 | A * | 4/2000 | Sheu et al. | 315/291 |
| 6,339,296 | B1 * | 1/2002 | Goral | 315/86 |
| 6,628,083 | B2 * | 9/2003 | Pickering | 315/86 |
| 7,045,964 | B1 * | 5/2006 | Hermans | 315/86 |

* cited by examiner

*Primary Examiner*—Douglas W Owens
*Assistant Examiner*—Tung X Le
(74) *Attorney, Agent, or Firm*—Ballard Spahr LLP

(57) ABSTRACT

The present invention relates to an emergency lighting system comprising one or more first lighting elements and a power supply/charging unit that is incorporated in a host lighting fixture having one or more second lighting elements such as an HID, incandescent or fluorescent lamp. Optionally, a heating element can be provided that allows operation of the system in temperatures too low for operation of conventional emergency lighting systems.

27 Claims, 15 Drawing Sheets

EMERGENCY LIGHTING SYSTEM

RELATED APPLICATIONS

This application claims the priority of U.S. provisional patent application Ser. No. 60/889,450 filed on Feb. 12, 2007, the entire disclosure of which is hereby incorporated herein by this reference for all purposes.

FIELD OF THE INVENTION

The present invention generally pertains to lighting and more particularly to emergency lighting and even more particular to LED emergency lighting systems having battery backup incorporated into a host fixture such as a high-intensity discharge (HID), incandescent or fluorescent fixture where such emergency systems are suitable for operation in all environments including outdoor and non-conditioned environments.

BACKGROUND OF THE INVENTION

In many instances, emergency lighting systems having battery-backup are environmentally limited in their operation by extreme temperatures, whether hot or cold. For instance, external fluorescent building-mount lighting units with battery packs generally cannot operate below approximately −40° Fahrenheit, which is a temperature experienced in many parts of the world. Furthermore, fluorescent light output is reduced in cold weather and incandescent lamps in HID fixtures require large, bulky battery packs because of their power needs. Because of the size of these large battery packs, they are generally remotely mounted and separately wired to the fixture. Further, many emergency fixtures required wired connections to two sources of power, a primary source and a secondary source. In the normal mode of operation, the primary source provides power to the fixture's lamp. The secondary source provides lighting power to the fixture's lamp when the primary source is in an outage mode. The secondary source can be, for example, a reliable circuit, a circuit from an uninterruptible power supply (UPS) or a centralized battery, etc. The secondary source provides lighting power to the fixture's lamp when the primary source is in an outage mode.

Therefore, what is needed is a lighting system that overcomes many of the challenges found in the art, some of which are described above.

SUMMARY

One embodiment according to the present invention provide an emergency lamp and power supply/charging unit that is incorporated in a host lighting fixture such as an HID, incandescent or fluorescent luminaire.

In one aspect, embodiments of a lighting fixture are described. The embodiments are comprised of one or more first lighting elements. The one or more first lighting elements are configured to be controlled and operably connected to a first source of power by a control system that includes a microcontroller. Further comprising the lighting fixture are one or more second lighting elements. The one or more second lighting elements have a second source of power. The one or more first lighting elements receive power from the first source of power and illuminate when the control system determines that said second source of power is in an undervoltage, momentary outage or sustained outage condition.

In one aspect, the first source of power is a battery, and said battery is incorporated within or attached to the lighting fixture.

In one aspect, the one or more first lighting elements comprise at least one LED. In one aspect, the one or more second lighting elements comprise at least one HID lamp.

The HID lamp, in various aspects, can be chosen from the group consisting of high-pressure sodium, mercury vapor and metal halide, or combinations thereof.

In one aspect, the one or more second lighting elements comprise at least one incandescent lamp.

In one aspect, the one or more second lighting elements comprise at least one fluorescent lamp.

In one aspect, the lighting fixture is further comprised of a heating element operably connected with the second source of power through the control system. The control system thermostatically controls the heating element and the heating element provides heat to the first source of power allowing operation of the lighting fixture in ambient temperatures below 0° C.

In one aspect, the lighting fixture further comprises a test switch operably connected with the control system. The test switch allows testing of the light fixture's operation.

In one aspect, the at least one of said one or more first lighting elements are tilted relative to a vertical axis passing through the lighting fixture such that light from the one or more first lighting elements can be directed downward and outward from the lighting fixture. In other aspects the footprint from the first lighting elements can be controlled through the use of tilting, reflectors, refractors or combinations thereof.

In one aspect, the control system of the lighting fixture is configured to determine whether said second source of power has voltage present. If the second source of power does not have voltage present, then determining whether the first source of power source is connected. If the second source of power does not have voltage present and the first source of power is not connected, then operation of the one or more first lighting elements is prevented when the first source of power is connected to the lighting fixture until the second source of power has a voltage present and then second source of power experiences an undervoltage, momentary outage or sustained outage condition. The one or more first lighting elements then receive power from the first source of power and illuminate.

In yet another aspect, a method of providing emergency lighting is described. The method comprises providing an emergency lighting fixture comprised of one or more first lighting elements and one or more second lighting elements. The one or more first lighting elements are configured to be controlled and operably connected to a first source of power by a control system that includes a microcontroller. The one or more second lighting elements have a second source of power. The second source of power is monitored by the control system to determine an undervoltage, momentary outage or sustained outage condition. The emergency lighting fixture is controlled such that the one or more first lighting elements are provided power from the first source of power when the second source of power enters an undervoltage, momentary outage or sustained outage condition. If the second source of power enters an undervoltage, momentary outage or sustained outage condition, one or more first lighting elements continue to be illuminated until after the second source of power exits the undervoltage, momentary outage or sustained outage condition or until said first source of power enters a power failure or undervoltage condition.

In one aspect, the method further comprises determining whether said second source of power has voltage present. If the second power source does not have voltage present, then determining whether said first power source is connected. If the second power source does not have voltage present and the first power source is not connected, then preventing operation of the one or more first lighting elements when the first power source is connected to the lighting fixture until the second source of power has a voltage present and the second source of power experiences an undervoltage, momentary outage or sustained outage condition, then said one or more first lighting elements receive power from the first source of power and illuminates.

Additional advantages of the invention will be set forth in part in the description which follows, and in part will be obvious from the description, or may be learned by practice of the invention. It is to be understood that both the foregoing general description and the following detailed description are exemplary and explanatory only and are not restrictive of the invention.

DETAILED DESCRIPTION OF THE DRAWINGS

The accompanying drawings, which are incorporated in and constitute a part of this specification, illustrate certain aspects of the instant invention and together with the description, serve to explain, without limitation, the principles of the invention and like reference characters used therein indicate like parts throughout the several drawings.

Figure 9A:
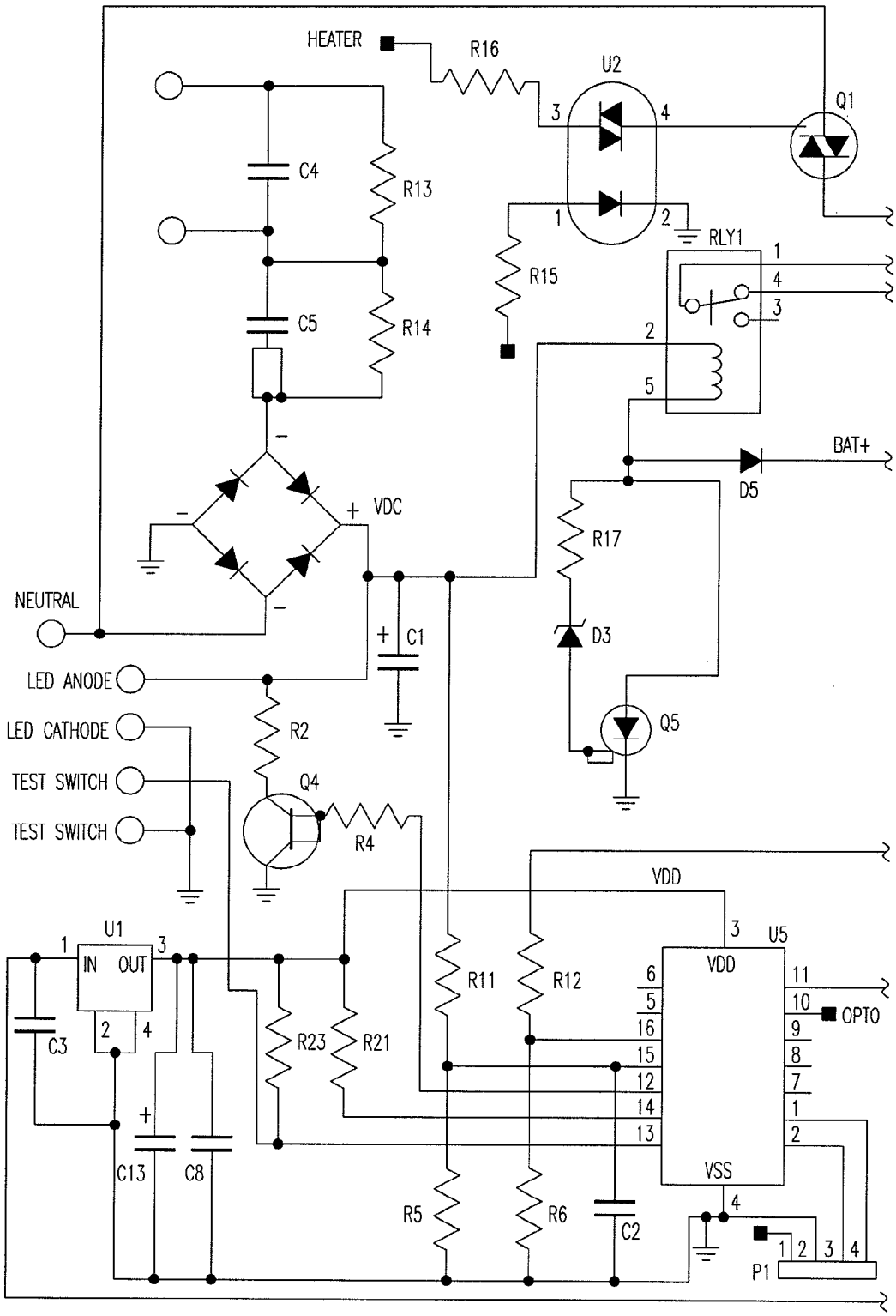
Figure 9B:
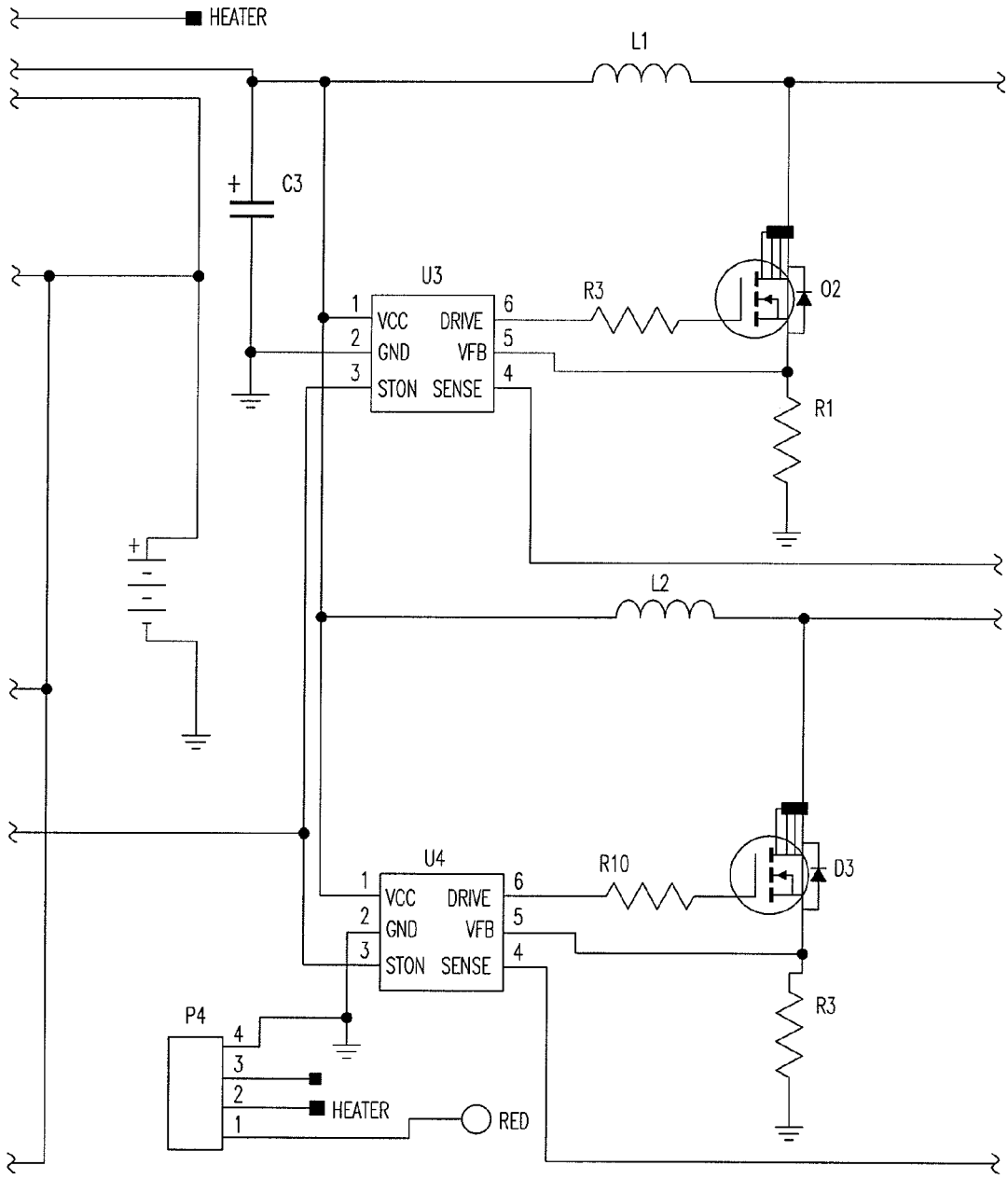
Figure 9C:
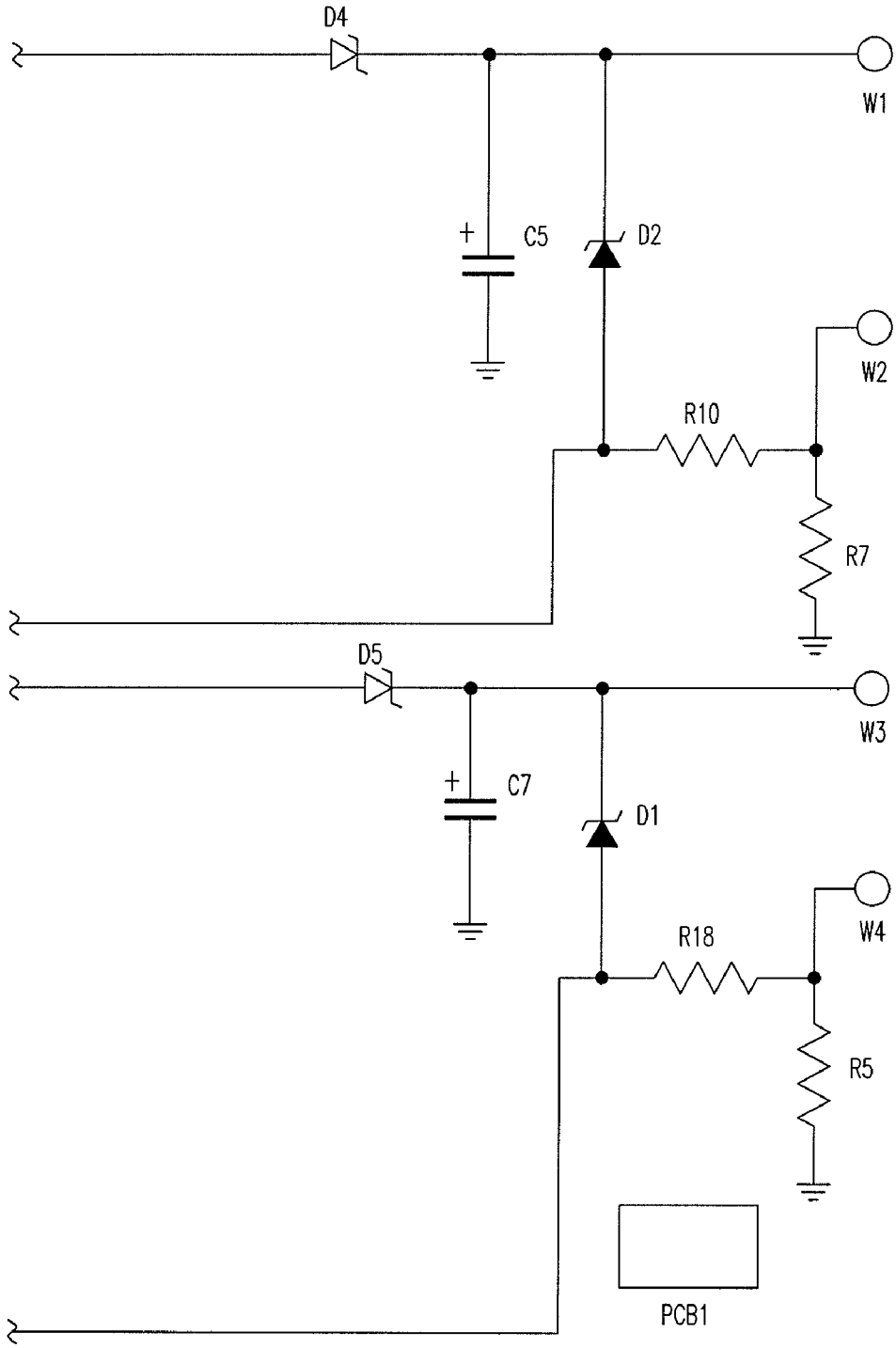
Figure 10:
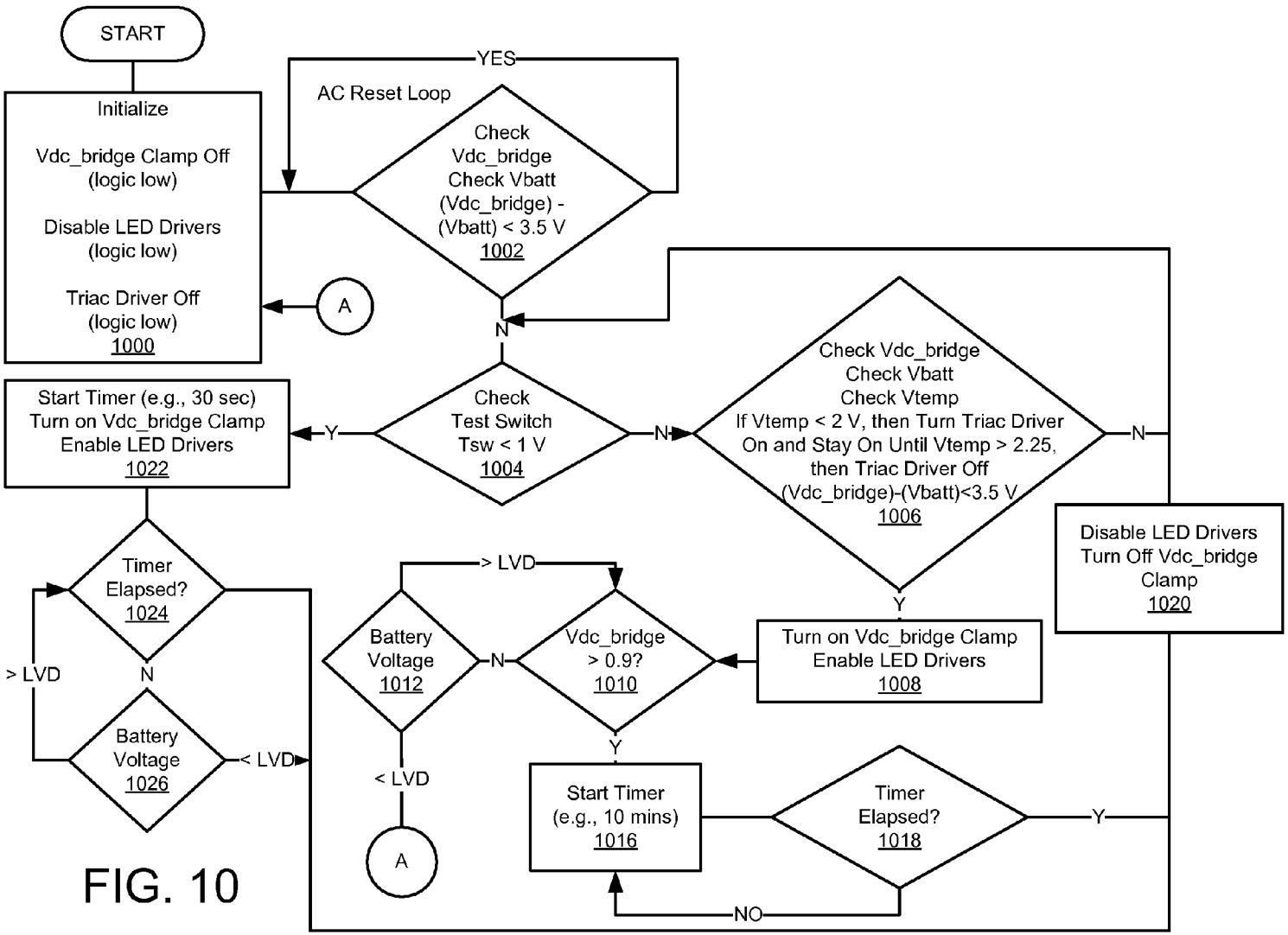

FIGS. 9A-9C illustrate an electrical schematic of an embodiment of a battery pack and charger for an LED emergency lighting system that can be used to practice one or more aspects according to the present invention; and FIG. 10 is a flowchart for a process of operating an LED driver and battery charger circuit with AC lockout that can be used to practice embodiments according to the present invention.

DETAILED DESCRIPTION

The present invention may be understood more readily by reference to the following detailed description of the invention and the examples included therein and to the figures and their previous and following description.

Before the present systems, articles, devices, and/or methods are disclosed and described, it is to be understood that this invention is not limited to specific systems, specific devices, or to particular methodology, as such may, of course, vary. It is also to be understood that the terminology used herein is for the purpose of describing particular embodiments only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used in the specification and the appended claims, the singular forms "a," "an" and "the" include plural referents unless the context clearly dictates otherwise. Thus, for example, reference to "a reflector" includes two or more such reflectors, and the like.

Ranges can be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that when a value is disclosed that "less than or equal to" the value, "greater than or equal to the value" and possible ranges between values are also disclosed, as appropriately understood by the skilled artisan. For example, if the value "10" is disclosed the "less than or equal to 10" as well as "greater than or equal to 10" is also disclosed. It is also understood that throughout the application, data is provided in a number of different formats and that this data represents endpoints and starting points, and ranges for any combination of the data points. For example, if a particular data point "10" and a particular data point 15 are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

"Optional" or "optionally" means that the subsequently described event or circumstance may or may not occur, and that the description includes instances where said event or circumstance occurs and instances where it does not.

As used herein, "exemplary" means "an example of" and is not intended to convey a meaning of an ideal or preferred embodiment.

Embodiments according to the present invention provide an emergency lighting system. In one embodiment according to the invention, the system is comprised of one or more emergency lighting elements such as light-emitting diodes (LED's), as are well-known in the art, that form an emergency lighting assembly (refer to FIG. 3), a charger/driver printed circuit-board (PCB) component (refer to FIGS. 7, 8 and 9A-9C), a battery pack (refer to FIGS. 4A-4C, 7, 8, and 9A-9C), an optional heater (refer to FIG. 5), a charge indicator light (pilot light) and test switch (refer to FIG. 6), a cast box enclosure (refer to FIG. 2), and a host fixture such as, for example, a HID, incandescent or fluorescent fixture, as are known in the art. HID fixtures can include, for example, those having lamps comprised of high-pressure sodium (HPS), mercury vapor, and metal halide lamps, as each are known in the art.

Figure 1A:
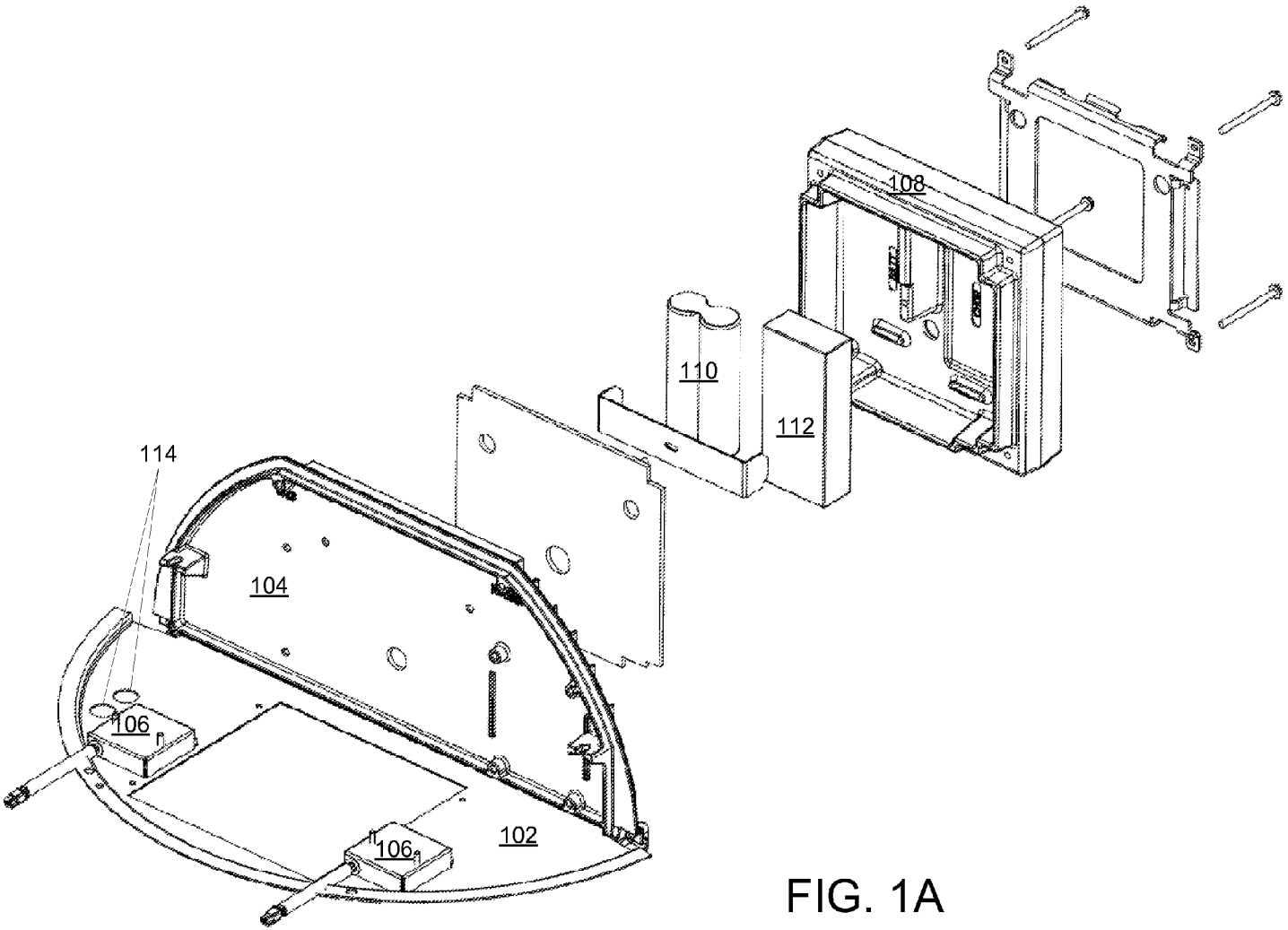
FIG. 1A is an illustration of exemplary LED emergency lighting system according to an embodiment of the present invention.

FIG. 1A is an illustration of exemplary emergency lighting system according to an embodiment of the present invention. In FIG. 1A, a bottom plate 102 and a back plate 104 form an apparatus that can be connected to a host fixture such as, for example, a wall-mount HID fixture. In one aspect, the bottom plate 102 comprises a reflector skirt of a host fixture. Attached to the bottom plate 102, in the embodiment according to FIG. 1A, are two emergency lighting assemblies 106 comprised of, for example, one or more LEDs. It is to be appreciated that more or fewer emergency lighting assemblies 106 can be used in various embodiments according to the invention and the use of two in FIG. 1A is a non-limiting example. Attached to the back plate 104 in this embodiment is a cast box enclosure 108 that substantially encloses a battery pack 110 and a charger/driver/control module 112. In one embodiment the battery pack 110 can be substantially wrapped or proximate to a heating element (see FIG. 5), allowing operation at lower temperatures. The heating element helps prevent thermal discharge of the battery during times when the primary power source is available to the lamp, but the lamp is not on. In some aspects, the back plat 104 can comprise a heat sink such that heat from the lamp, when it's on, will not overheat and/or damage the battery and the charger/driver/control module.

The embodiment of FIG. 1A is designed to be incorporated into a host fixture for an incandescent, fluorescent, HID or other form of lighting generally operating on alternating-current (AC) power as the primary power source. The charger/driver/control module 112 is generally normally connected to an AC source (the primary source) to maintain a charge on the battery pack 110. The optional heater, if provided, is also electrically connected to the primary source. In the embodiment of FIG. 1A, connectorized flexible leads from the emergency lighting assemblies 106 are routed through the back plate 104 to the cast box enclosure 108, where the emergency lighting assemblies are electrically connected with the battery pack 110 and charger/driver/control module 112. The backplate can have one or more holes 114 that allow access to a test switch 122 (see FIGS. 1C and 6) that allows the emergency lighting assemblies to be tested. The one or more holes 114 can also provide visibility to a pilot light or charge-indicating light 124 that provides visual indication whether the battery pack 110 is charged to within a certain range or other visual indicators. The one or more holes 114 can provide means for visually determining the status of the emergency lighting system without opening a host fixture. In one embodiment, the one or more emergency lighting elements 120 (see FIG. 1C) in the emergency lighting assembly 106 are connected or proximate to a heat sink enclosure/mounting device to assist in thermal management of the emergency lighting assembly 106. The emergency lighting assembly 106 can be connected, for example, to a main reflector skirt of a host fixture.

Figure 1B:
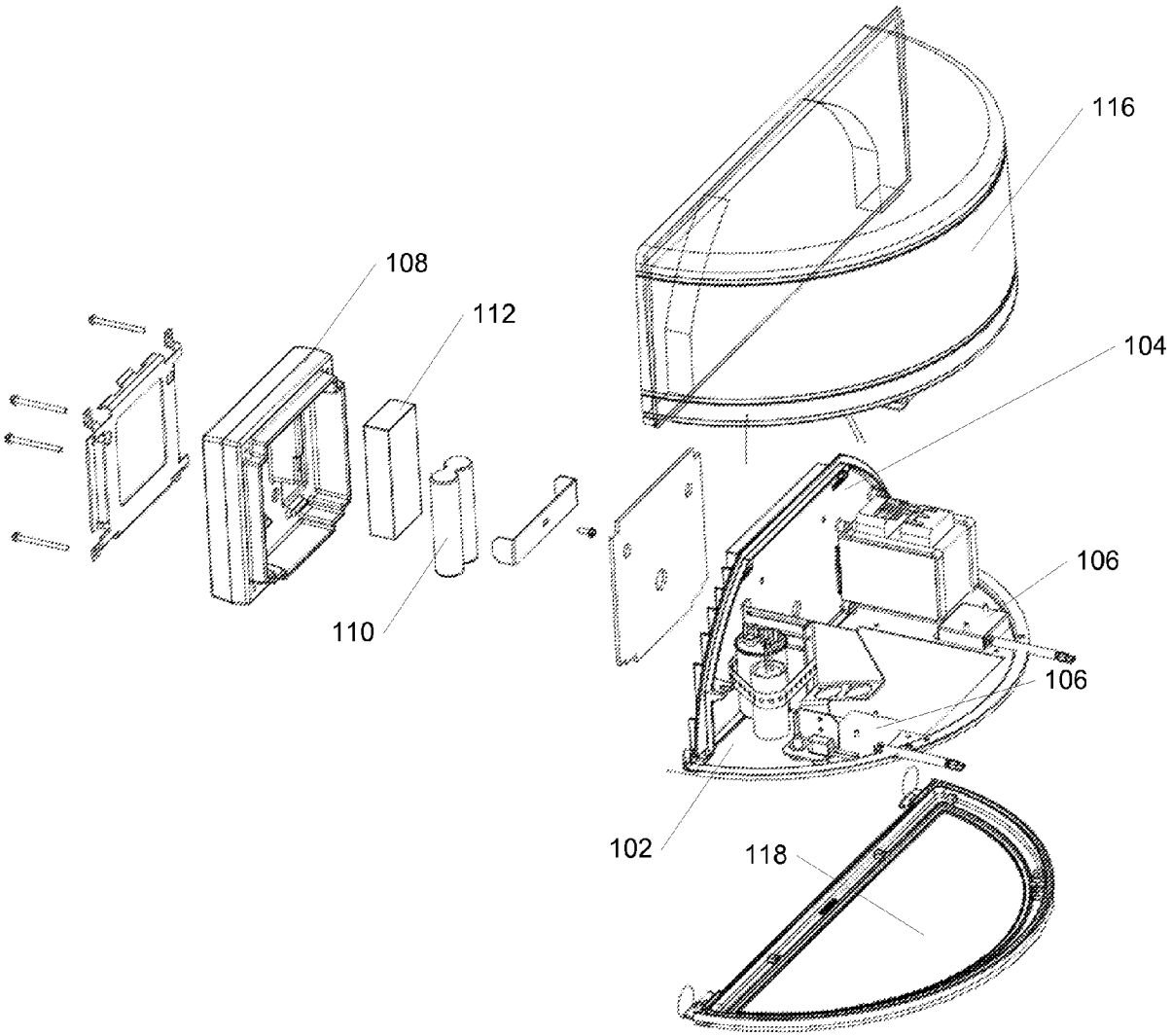
FIG. 1B is an illustration of an exploded view of a lighting fixture having an exemplary LED emergency lighting system incorporated therein according to an embodiment of the present invention.

FIG. 1B is an illustration of an exploded view of a lighting fixture having an exemplary emergency lighting system incorporated therein according to an embodiment of the present invention. This embodiment further is comprised of a cover 116 and a substantially clear or opaque lens 118. The cover 116 can be made of materials such as metals or plastics and protects the components of the fixture from the elements. The lens 118 is generally comprised of plastic or glass. In one aspect, the emergency lighting elements that comprise the emergency lighting assemblies are LEDs.

Figure 1C:
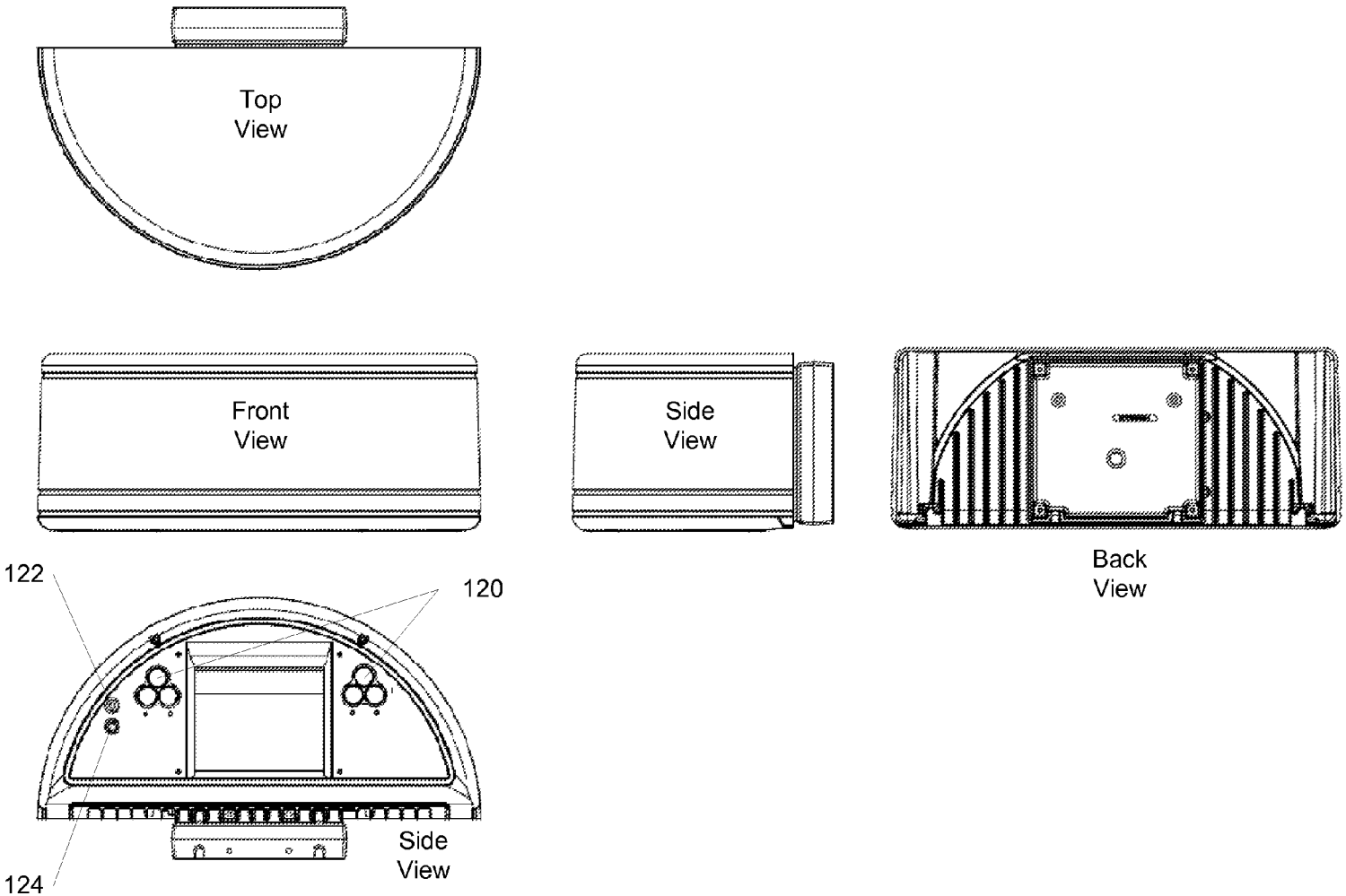
FIG. 1C is an illustration of an exterior view of a lighting fixture having an exemplary LED emergency lighting system incorporated therein according to an embodiment of the present invention.

FIG. 1C is an illustration of exterior views of a lighting fixture having an exemplary emergency lighting system incorporated therein according to an embodiment of the present invention. This view shows the exterior of the lighting fixture from the bottom, from which in this instance the light radiates; however, it will be appreciated that the term "bottom" is not meant to be directionally limiting, and further, embodiments in which light radiates through more or other sides are envisioned in this disclosure. In this figure, an exemplary arrangement of the emergency lighting elements 120, for example LEDs, can be seen. The emergency lighting elements 120 as shown in this example can be oriented at an angle from normal to the bottom of the exterior of the fixture. The emergency lighting elements 120 can be oriented thusly by tilting the entire emergency lighting assembly 120, by or by tilting the emergency lighting elements 120 individually. This tilted orientation can allow the emergency lighting elements 120 to cast light in a direction corresponding to the tilt, allowing for greater light coverage. However, it will be appreciated that other arrangements for increasing, decreasing, altering or controlling light coverage areas, such as with reflectors, refractors or other like means known in the art and combinations thereof, are contemplated herein.

Figure 2:
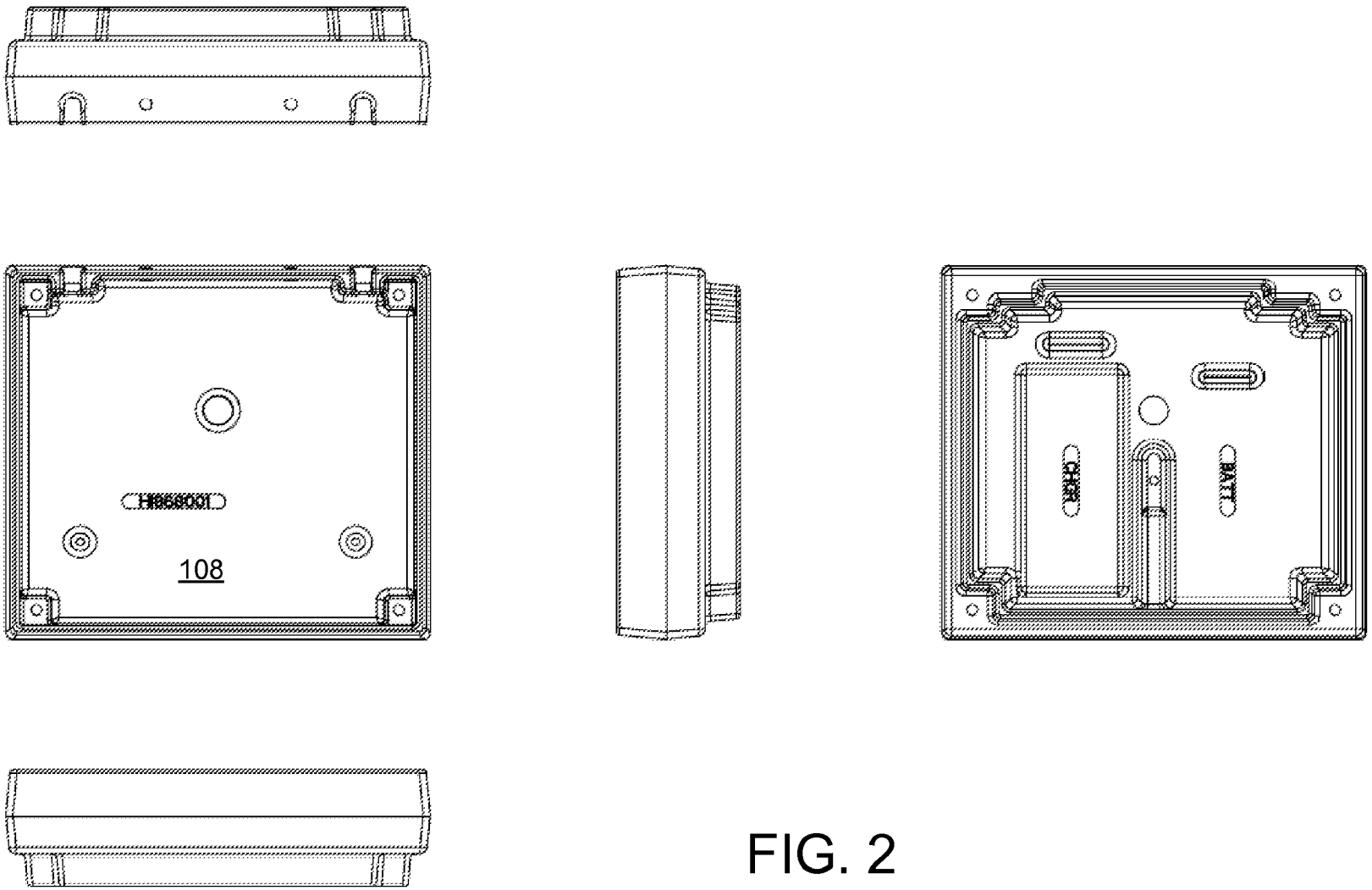
FIG. 2 is an illustration of an exemplary cast box enclosure for an LED emergency lighting system that can be used to practice one or more embodiments according to the present invention.
Figure 5:
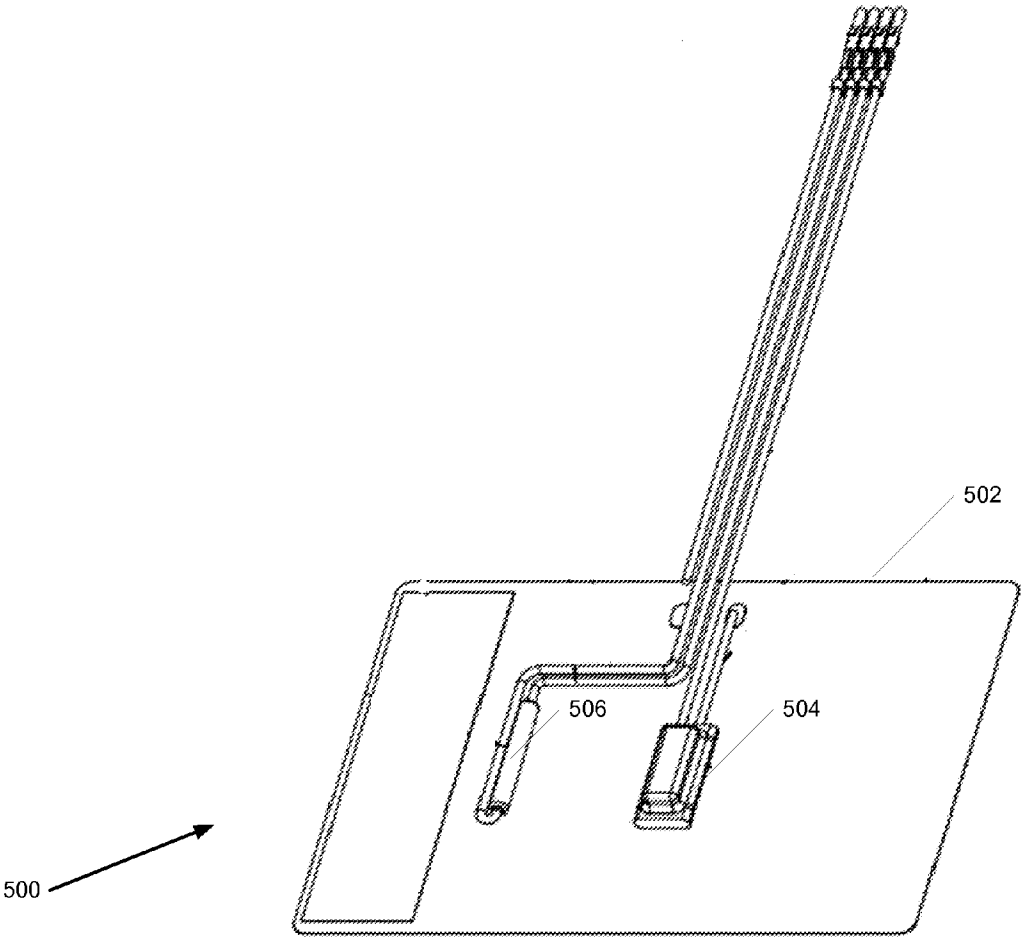
FIG. 5 is an illustration of an exemplary heater blanket of a battery pack for an LED emergency lighting system that can be used to practice one or more embodiments according to the present invention.

FIG. 2 provides various views of an illustration of an exemplary box enclosure 108 for an emergency lighting system that can be used to practice one or more embodiments according to the present invention. Generally, this enclosure is used to house the battery pack 110, charger/driver/control module 112, and the (optional) heating element (FIG. 5). The box enclosure 108 can be comprised of one or more of plastics, metals, cast metals, or other suitable materials. It is to be appreciated that multiple forms and shapes of this enclosure are contemplated within the scope of this invention.

Figure 3:
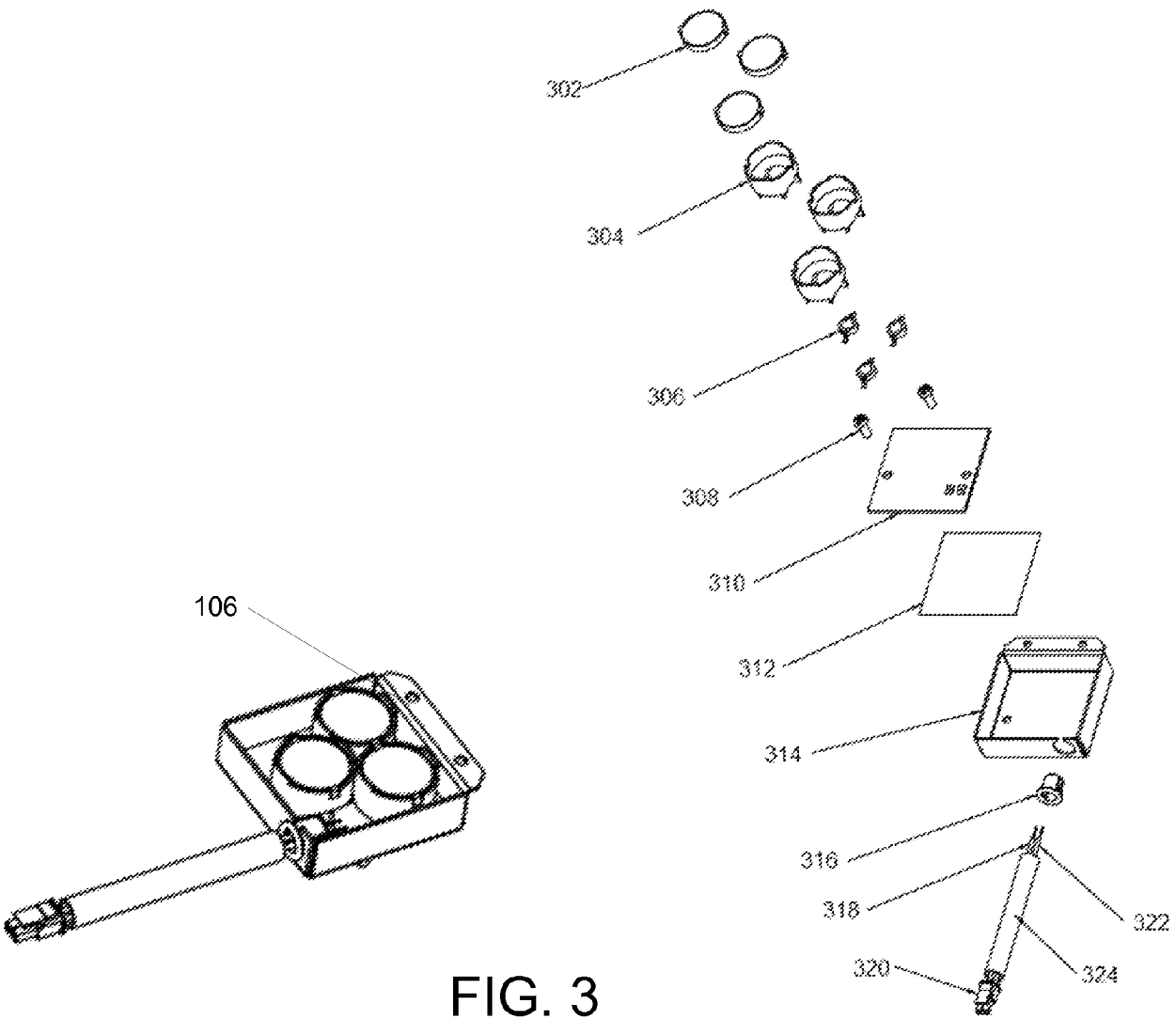
FIG. 3 is an exploded view of an exemplary LED assembly for an LED emergency lighting system that can be used to practice one or more embodiments according to the present invention.

FIG. 3 is an exploded view of an exemplary emergency lighting assembly 106 for an emergency lighting system that can be used to practice one or more embodiments according to the present invention. In this example, the emergency lighting assembly 106 of the embodiment of FIG. 3 is comprised of, for example, three LED lighting elements arranged in a triangular formation, though it is to be appreciated that the emergency lighting assembly 106 can be comprised of more or fewer LED lighting elements. A connectorized lead electrically connects each lighting element of the emergency lighting assembly 106 to a battery pack 110 and charger/driver/control module 112. Specifically, the embodiment shown in FIG. 3 is comprised of optical lens 302, lens holder 304, LEDs 306, screws 308, metal core 310, thermal interface 312, housing 314, bushing 316, connector plug 320, wiring 318, 322, and sleeving 324, though other designs and constructions are contemplated within the scope of this invention.

Figure 4C:
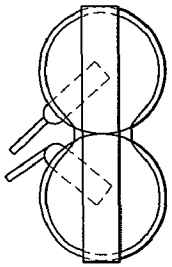
FIGS. 4A-4D illustrate an exemplary battery pack for an LED emergency lighting system that can be used to practice one or more embodiments according to the present invention.
Figure 4B:
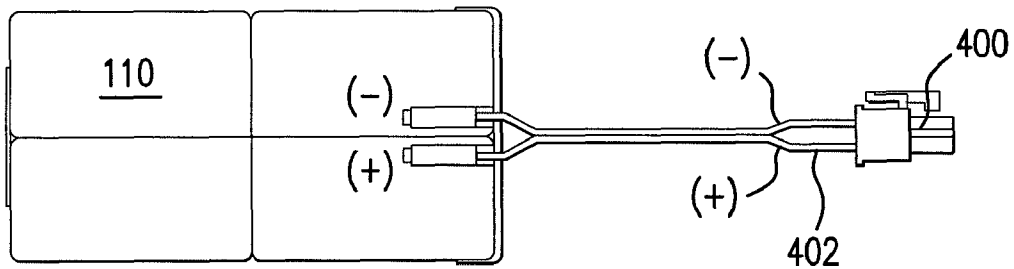
Figure 4D:
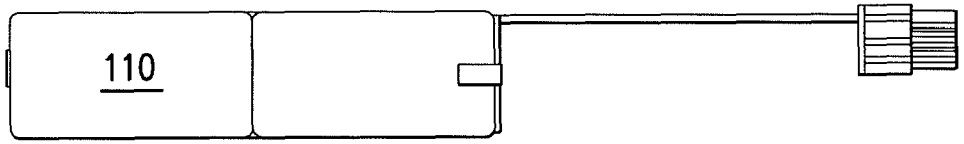
Figure 4A:
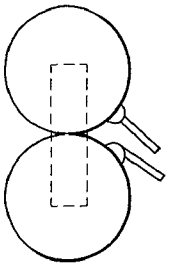

FIGS. 4A-4D illustrate an exemplary battery pack 110 for an emergency lighting system that can be used to practice one or more embodiments according to the present invention. In the embodiment of FIGS. 4A-4C, the battery pack 110 is comprised of a nickel cadmium (NiCad) 4.8-volt, 3.0 amp-hour battery, though other batteries having different various ratings are contemplated within the scope of the invention. In the shown embodiment, the battery pack has an electrical connector 400 on its wire leads 402.

FIG. 5 is an illustration of an exemplary heater blanket 500 of a battery pack for an emergency lighting system that can be used to practice one or more embodiments according to the present invention. The heater blanket is an optional feature of the emergency system and is generally used where the ambient temperature can be below, for example, 32° Fahrenheit or −20 Celsius. The heater blanket 500 is comprised of a heater pad 502 comprising flexible material having resistive heating elements that are electrically connected to an AC power source for warming the battery pack. The heater blanket can also incorporate a thermal cutoff 504 to avoid overheating and be thermostatically controlled by, for example, the charger/driver/control module 112 or a thermistor element 506. Generally, the heater blanket 500 is switched off when the emergency lighting assemblies 106 are drawing power from the battery pack 110.

Figure 6:
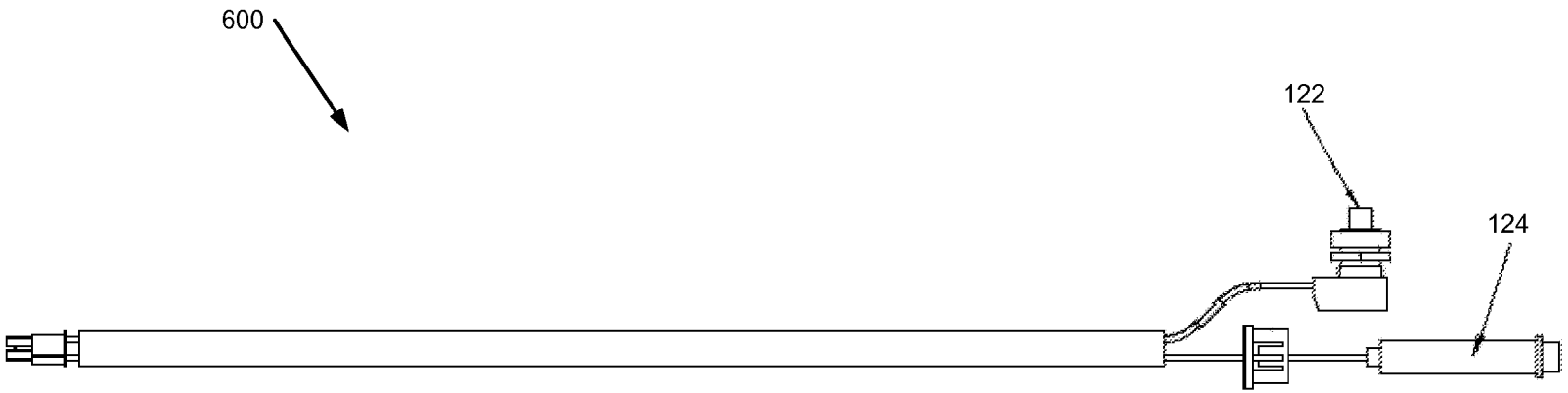
FIG. 6 is an illustration of an exemplary pilot light/test switch for an LED emergency lighting system that can be used to practice one or more embodiments according to the present invention.

FIG. 6 is an illustration of an exemplary pilot light/test switch 600 for an emergency lighting system that can be used to practice one or more embodiments according to the present invention. As described in relation to FIG. 1C, above, the pilot light (or charge indicator light) 124 indicates whether the battery is charged to within an acceptable range. The light is controlled by the charger/driver/control module 112. The test switch 122 is used to simulate a loss of power occurrence that would trigger the emergency lighting system to activate. The test switch 118 can also be used to reset the emergency lighting system so that it is prepared to re-activate at the next occurrence of AC power.

Figure 7A:
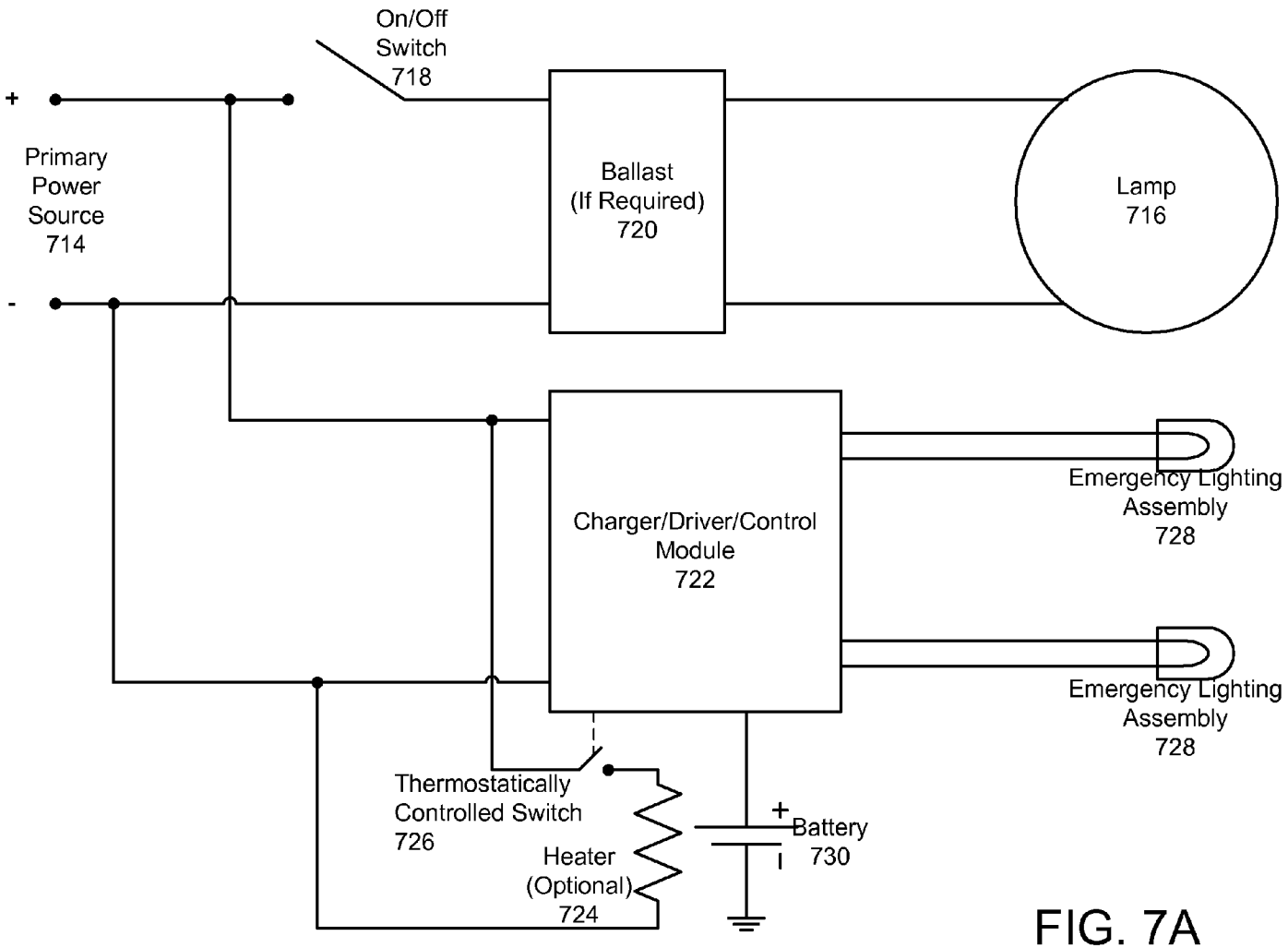
FIG. 7A is an exemplary electrical schematic of an emergency lighting system according to the present invention.

FIG. 7A is an exemplary electrical schematic of an emergency lighting system according to the present invention. The embodiment according to FIG. 7A is comprised of a primary power source 714 that normally supplies power to a lamp 716 of a fixture through an on/off switch 718 and a ballast 720 (which may or may not be required depending upon the type of lamp used). The primary power source 714 also provides power to a charger/driver/control module 722 and optionally a heater 724. The optional heater 724 is operationally controlled by a thermostatically-controlled switch 726 that is monitored and operated by the control module 722 or by a thermostatic device incorporated into the heater 724. The charger/driver/control module 722 is operably connected with one or more emergency lighting assemblies 728, each having one or more emergency lighting elements. The charger/driver/control module 722 is also operably connected with a battery 730. In the event of loss or undervoltage condition of the primary power source 714, the charger/driver/control module 722 is configured to cause the emergency lighting assemblies 728 to be supplied power from the battery 730 and to turn on. When the primary power source is restored to normal operation, the charger/driver/control module 722 is configured to cause the emergency lighting assemblies 728 to turn off.

Figure 7B:
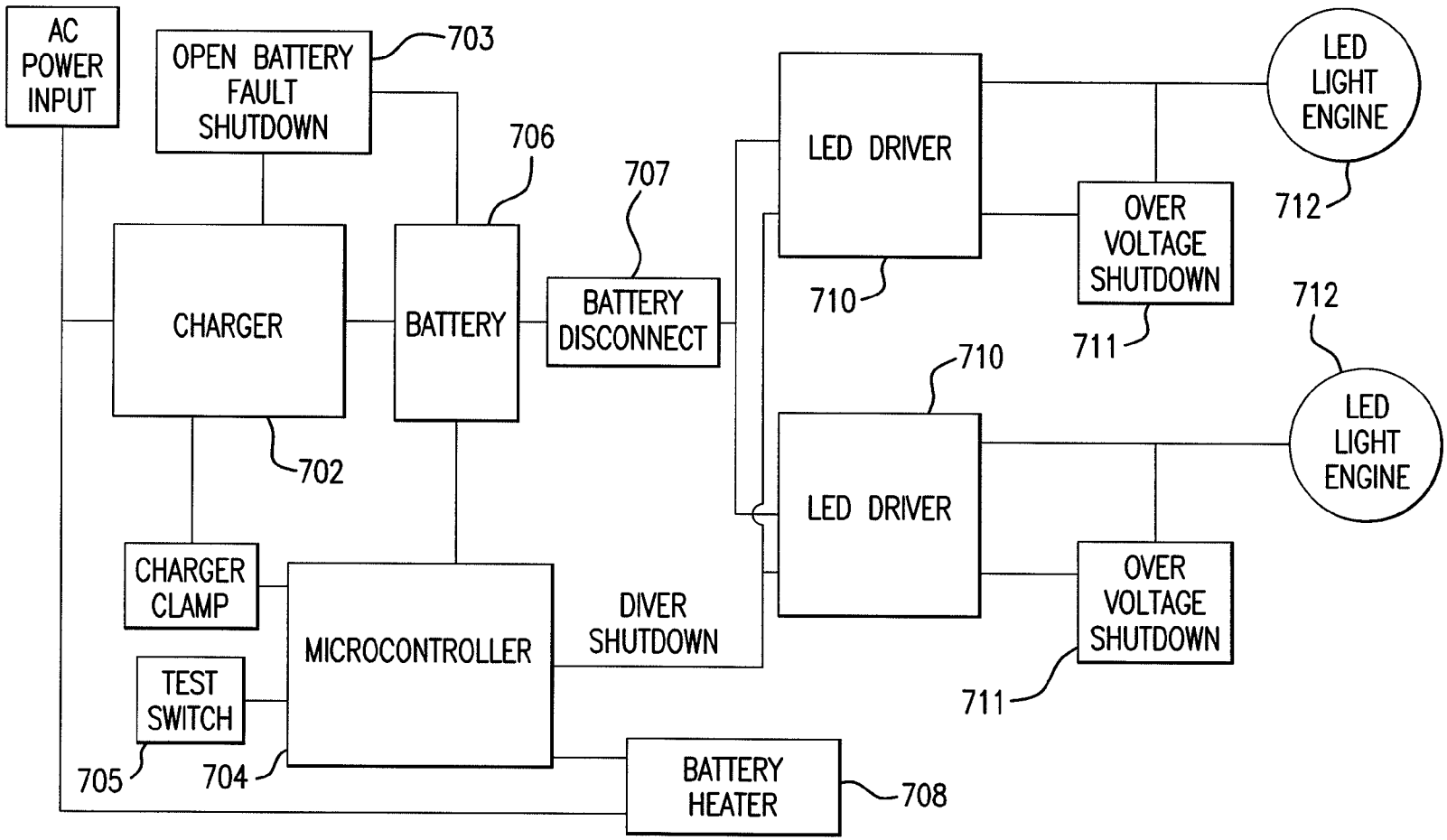
FIG. 7B is a block diagram of components of an embodiment of an LED emergency lighting system according to the present invention.

FIG. 7B is a block diagram of components of an embodiment of an emergency lighting system according to the present invention. Major components comprising the embodiment of an emergency lighting system as shown in FIG. 7B include a charger 702, an open-battery fault shutdown 703, a microcontroller 704, a test switch 705, a battery pack 706, a battery disconnect 707, a battery heater (optional) 708, LED drivers 710, one or more over voltage shutdown devices 711 and, in this example, one or more LED light elements that comprise LED light engines 712.

Logic features of the embodiment of an emergency lighting system shown in FIGS. 7A and 7B include a low-voltage battery disconnect, battery over-voltage detection, re-strike time delay, brownout detection, open lamp shutdown, open battery shutdown, AC lockout, AC lockout reset, microcontroller driver shutdown control, user-initiated emergency test, and battery temperature control. These features are generally carried out by the microcontroller 704 in operative communication with other components of the emergency lighting system. The logic features are generally further described below.

Low Voltage Battery Disconnect: If battery low voltage is detected during emergency mode, the battery is returned to charge mode. If the primary power source is not present when the battery is returned to charge mode, then the system reverts to AC lockout mode (described herein).

Battery Over-Voltage Detection: If an over-voltage condition is detected at the battery, then the battery charge function is turned off.

Re-Strike Time Delay: When returning from a power failure/emergency mode of operation, the emergency lighting assemblies remain on for an additional period of time such as, for example, 10 minutes. This allows proper re-strike and substantially full illumination of the primary lamp (e.g., HID, incandescent, fluorescent).

Brownout Detection: This optional feature allows the emergency lighting system to come on during intermittent low-voltage conditions. With this feature, emergency mode operation is not started until the line voltage value of the primary power source is below a predetermined level.

Open Lamp Shutdown: This feature shuts down an emergency lighting element driver such as, for example, an LED driver 710, if no emergency lighting element is attached to the driver 710.

Open Battery Shutdown: With this feature, if an open battery condition is detected the battery charger shuts down.

AC Lockout: AC lockout is a logic process implemented by the microcontroller. The process comprises attaching a battery for the first time to the charger/driver/control module that comprises the emergency lighting system. If the battery is being attached for the first time, without the primary power source present (i.e., no voltage), the microcontroller prevents the battery from discharging into the drivers that control the emergency lighting assemblies and emergency lighting elements. Once the primary power source is detected (i.e., voltage is present), then following primary power source failure and/or undervoltage results in a battery discharge and operational drivers.

AC Lockout Reset: The AC lockout feature can be re-enabled by pressing the test switch a defined number of times within a defined period of time, for example, three times within 5 seconds. This feature can be used during production testing and field troubleshooting. This resets the AC lockout logic process such that when the battery is attached for the first time after the AC lockout reset, without the primary power source present (i.e., no voltage), the microcontroller prevents the battery from discharging into the drivers that control the emergency lighting assemblies and emergency lighting elements.

Figure 8:
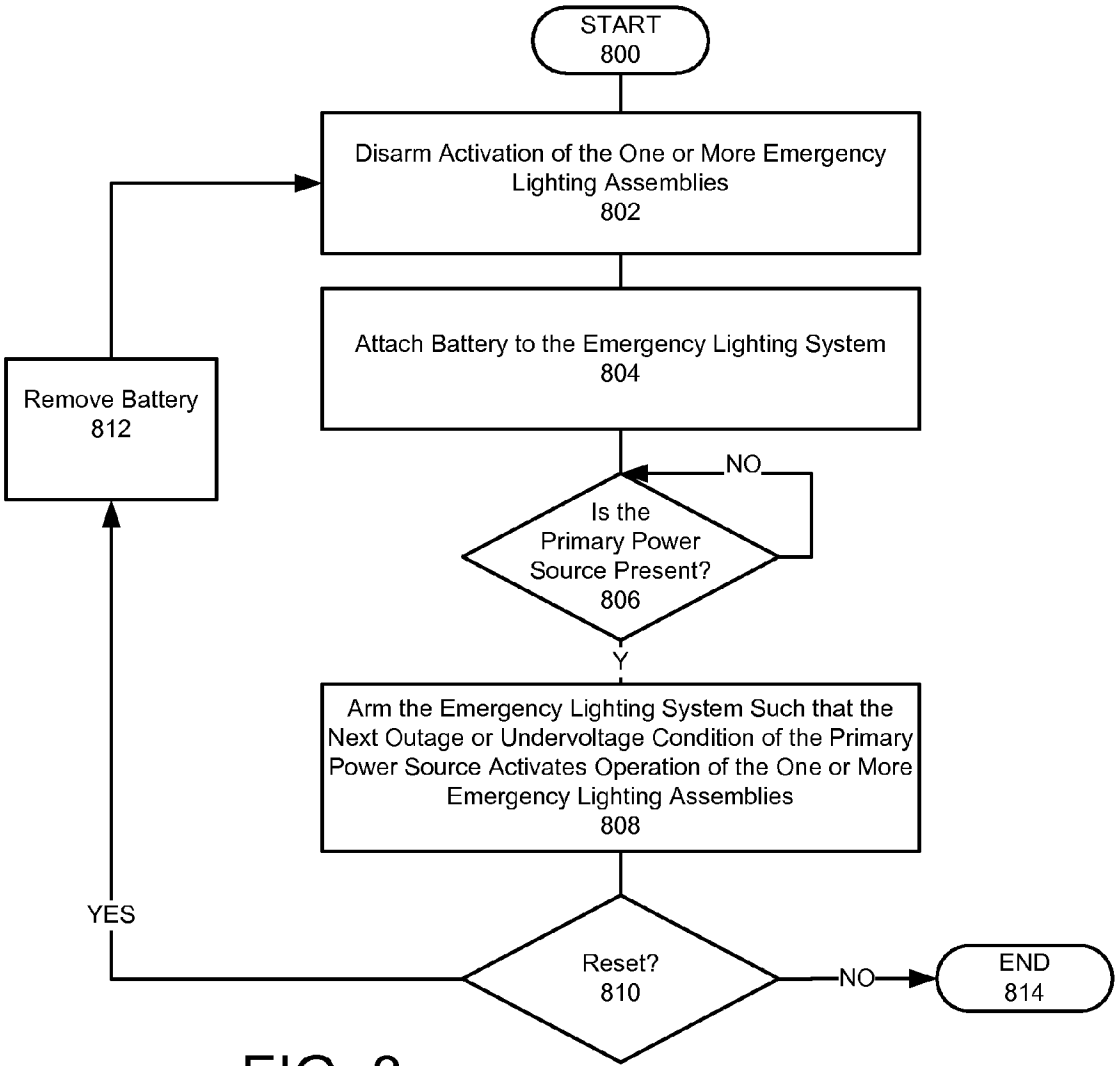
FIG. 8 is a flowchart illustratively showing AC lockout and AC lockout reset processes that can be used to practice embodiments according to the present invention.

The AC lockout and AC lockout reset processes are illustratively shown in the exemplary flowchart of FIG. 8. The process starts at step 800. At step 802, activation of the one or more emergency lighting assemblies is disarmed by the microcontroller. At step 804, a battery is attached to the emergency lighting system to serve as a source of power in event of loss of a primary power source. At step 806, the microcontroller determines whether the primary power source is present (i.e., whether the primary power source is above a threshold voltage). If not, then the process continues to monitor for the primary power source to be detected. If, at step 806, the primary power source is present, then at step 808 the emergency lighting system is armed such that the next outage or undervoltage condition of the primary power source activates operation of the one or more emergency lighting assemblies that comprise the emergency lighting system. At step 810, it is determined whether a reset of the ac lockout is performed. As described above, in one aspect this can be undertaken by pressing a test switch a defined number of times within a defined period of time, for example, three times within 5 seconds. If AC lockout is reset at step 810, then at step 812 the battery can be removed and the process returns to step 802. Else, if a reset is not performed at step 810, the process ends at step 814.

Microcontroller Driver Shutdown Control: This feature provides the microcontroller 704 control over the turning on/off of the drivers 710 for the emergency lighting elements depending on the charger 702 and battery pack 706 states.

User-Initiated 30 Second Emergency Test Under Microcontroller Control: The microcontroller is programmed to automatically perform an emergency test when the test switch is momentarily pressed. If the switch is continually pressed the unit remains in emergency mode until the switch is released. In one aspect, when the test switch is depressed the one or more LEDs 728 turn on. If the test switch is depressed again (momentarily), then the emergency test is cancelled. If the test switch and held, then the microcontroller will return to normal mode.

(Optional) Battery Temperature Control: The microcontroller 704 can maintain an approximate desired battery temperature. For example, a battery temperature of 15 C to 20 C can be maintained when ambient temperature is between −20 C and 20 C.

FIGS. 9A-9C illustrate an electrical schematic of an embodiment of a battery pack 706 and charger 702 for an LED emergency lighting system that can be used to practice one or more aspects according to the present invention when the emergency lighting elements are connected in series. It is to be appreciated that in alternative embodiments the emergency lighting elements can be connected in parallel and that the "boost" electronics described below can generally be replaced with "buck" electronics for parallel operation. In FIGS. 9A-9C, the charger circuit can be comprised of current limiting capacitors (C4, C5), diode rectifier bridge BR1, DCV filter capacitor C1, relay coil RLY1, blocking diode D6 and a battery. In this embodiment, the battery is a 6-volt, 4 amp-hour battery, though batteries of different voltages and capacity are contemplated within the scope of this invention. The resistors (R13, R14) are capacitor charge bleeders for safety.

The LED driver circuit can be powered from the battery through the relay contact of RLY1. The LED driver circuit can be comprised of DC input filter capacitor C3, boost converter controllers (U3, U4), boost converter inductors (L1, L2), boost transistors (Q2, Q3), current sense resistors (R1, R3), boost diode (D4, D5), output filter capacitors (C6, C7) and LED current sense resistors (R7, R8). In this embodiment, two drive circuits provide constant current to the LED lamp assemblies.

The Open Lamp Shutdown circuit comprises Zener diodes D2, D1 and resistors (R19, R18).

The Battery Over-Voltage Detection circuit consists of SCR Q5, Zener diode D3, and bias resistor R17.

The Charger Clamp consists of current sensing resistor R2, clamping transistor Q4, and bias resistor R4.

The battery heater circuit, which is controlled by the microcontroller U5, can be comprised of bias resistors (R15, R16), optocoupler U2, and triac Q1. This circuit provides regulated power to the battery heater in order to maintain a constant temperature on the battery pack. Battery pack temperature can be sensed by means of resistor R21 and an external thermistor mounted on the battery pack.

The microcontroller can be programmed to sense one or more of battery voltage, charge voltage, test switch voltage, and thermistor voltage.

The microcontroller can be programmed to output control signals to boost controller ICs (U3, U4) enable pin, charger clamp transistor Q4 base, and heater triac Q1 gate bias through optocoupler U2. Charger voltage and battery voltage can be scaled down by means of resistors (R11, R5) and resistors (RR12, R6).

The microcontroller can be powered from the battery by means of a voltage regulating circuit comprised of input filter capacitor C9, low voltage dropout regulator U1, and output filter capacitors (C8,C13). In one embodiment, the regulator has about a 1% output tolerance to effectively provide an acceptable reference voltage for the microcontroller.

Table 1, below, is an exemplary bill of materials that can comprise the circuit shown in the electrical schematic of FIGS. 9A-9C:

TABLE 1

| Description | Value | Rating | Tol. | ID |
|---|---|---|---|---|
| BRIDGE RECTIFIER | 4L DF06 | 600 | 0% | BR1 |
| CAP, ELECTROLYTIC | 220U | 35 V | 0% | C1 |
| CAPACITOR | 1U | 10 V | 80% | C2 |
| CAP, ELECTROLYTIC | 22U | 35 V | 20% | C3, C6-7 |
| CAP, SEGMENTED FILM | 4U | 220 VAC | 5% | C4 |
| CAP, SEGMENTED FILM | 6U | 220 | 5% | C5 |
| CAPACITOR | 100N | 50 V | 20% | C8-9 |
| CAP, TANTALUM | 22U | 6.3 | 20% | C13 |
| DIODE, ZENER | MMSZ15T1G | 15 | 5% | D1-3 |
| DIODE, SCHOTTKY | SS22 VISHAY | 20 V | 0% | D4-5 |
| DIODE, RECTIFIER | 1N4005 | 600 | 0% | D6 |
| INDUCTOR | 22U | | 10% | L1-2 |
| HEADER, 4 POS., VERT | 0.1CTR. | | | P1 |
| HEADER 2PIN | 644486-2 | 7 | | P2 |
| HEADER 4PIN | 43650-400 MO | 5 | | P4 |
| PRINTED CIRCUIT BOAR | | | | PCB1 |
| TRIAC | Q6004F31 | 4 | | Q1 |
| MOSFET, N | NTGS3446T1 | | | Q2-3 |
| TRANSISTOR, NPN | | | | Q4 |
| THYRISTOR | MCR100-6 | 0.8 | | Q5 |
| RESISTOR | .015 | .5 W | 5% | R1, R3 |
| RESISTOR | 4.7 | ½ W | 5% | R2 |
| RESISTOR | 1.8K | 0.25 W | | R4 |
| RESISTOR | 12K | 0.25 W | | R5-6 |
| RESISTOR | 1 | .5 W | | R7-10 |
| RESISTOR | 220K | 0.25 W | 5% | R11-12 |
| RESISTOR | 1MEG | 0.5 W | 10% | R13-14 |
| RESISTOR | 1K | 0.25 W | | R15-19 |
| RESISTOR | 10K | 0.25 W | 5% | R20 |
| RESISTOR | 130K | 0.25 W | | R21 |
| RELAY, SPDT | | | | RLY1 |
| IC, REGULATOR | LM2931Z-5.0 | | | U1 |

TABLE 1-continued

| Description | Value | Rating | Tol. | ID |
|---|---|---|---|---|
| IC, OPTO | MOC3052M | | | U2 |
| IC, LINEAR/INTERFACE | ZXSC400 | | | U3-4 |
| IC, MICRO | MC9S08QG4 | | | U5 |
| TERMINAL, MINIATURE | | | | WH1-12 |

It is to be appreciated that the devices listed in Table 1 are provided as a non-limiting example of the materials that can comprise an embodiment of a circuit as shown in FIGS. 9A-9C, and that other devices having other ratings that perform the same, similar or equivalent function as the circuit shown in FIGS. 9A-9C are contemplated within the scope of this invention.

In one embodiment, operation of the LED emergency lighting system by the circuit shown in the electrical schematic of FIGS. 9A-9C occurs as shown in FIG. 10.

FIG. 10 is an exemplary flowchart for a process of operating an LED driver and battery charger circuit with AC lockout that can be used to practice embodiments according to the present invention. The process shown in FIG. 10 begins with an initialization stage 1000; subsequently an initial determination 1002 is made, where it is determined if the LED emergency lighting circuit assembly (as shown in FIGS. 7A, 7B and 9) is wired to the LED lamps and an AC line connection is connected but AC power is not present. If these conditions are present, and the battery has been attached for the first time, then the microcontroller powers up and insures the charger clamp is off, the boost controller ICs are disabled and the battery heater is enabled such that it is configured to warm the battery pack at a predetermined ambient temperature. In this instance, when the battery heater is enabled, no power is supplied to the heater because the AC source is not present. This state is generally referred to as AC lockout, as described herein. The microcontroller waits for the AC power to appear across sensing resistors (R11, R5). When this condition is detected, the microcontroller maintains its previous state allowing the battery to charge and heater to regulate battery temperature.

In the next stage 1004, the microcontroller determines if a user pressed the test switch. If a user has not, the microcontroller then determines if_a power failure is present 1006 (or voltage falls below the preset brownout level) through resistors (R11, R5) and the battery voltage divider resistors (R12, R6). This voltage difference is proportional to the AC line voltage. The microcontroller compares the value to a preset value, and then enables the boost converters and turns on the LEDs at stage 1008. In addition, the microcontroller turns on the charger clamp. Then, at stage 1010, the microcontroller determines if the discharge is excessive and if it is, then microcontroller proceeds to step 1012, where it checks whether the battery voltage falls below a low voltage preset. If the voltage is below the low voltage preset, the microcontroller returns to point a where it disables the boost converters and thereby turns the LEDs off. The microcontroller waits for the AC power to return as sensed across clamp resistor R2. On the other hand, if the AC power returns during the discharge (emergency) mode, the microcontroller maintains the LEDs in an "on" state for a predetermined time period, such as, for example, 10 minutes, at step 1016.

When the microcontroller determines the predetermined time period (e.g., 10 minutes) has elapsed 1018, the microcontroller terminates the emergency mode at 1020 by disabling the boost converters and releasing the charger clamp.

If the LED emergency lighting system is in a charge (normal) mode and the microcontroller at 1004 determines that a user presses the test switch momentarily, the microcontroller initiates a test sequence at 1022. The microcontroller turns on the charger clamp and enables the boost converters, thereby turning on the LEDs. The LEDs remain on for a predetermined time period (e.g., about 30 seconds) at stage 1024, unless the test switch is continuously depressed. The microcontroller will also check to ensure that the voltage is above the low voltage preset at 1026. If the voltage falls below the low voltage preset, or upon termination of the predetermined time period, the microcontroller at 1020 disables the boost converters by turning off the LEDs and turning off the charger clamp.

During any battery discharge (emergency mode), LED emergency lighting system can be returned to the AC lockout by, for example, pressing the test switch one or more times (e.g. three times) within a defined period of time (e.g., about 5 seconds).

Although several aspects of the present invention have been disclosed in the foregoing specification, it is understood by those skilled in the art that many modifications and other aspects of the invention will come to mind to which the invention pertains, having the benefit of the teaching presented in the foregoing description and associated drawings. It is thus understood that the invention is not limited to the specific aspects disclosed hereinabove, and that many modifications and other aspects are intended to be included within the scope of the appended claims. Moreover, although specific terms are employed herein, as well as in the claims which follow, they are used only in a generic and descriptive sense, and not for the purposes of limiting the described invention.

We claim:

1. A lighting fixture comprising:

one or more first lighting elements;

a first source of power, wherein said first source of power is a battery, and said battery is incorporated within or attached to said lighting fixture;

a control system that includes a microcontroller, wherein the one or more first lighting elements are configured to be controlled and operably connected to the first source of power by the control system; and one or more second lighting elements having a second source of power, wherein said one or more first lighting elements receive power from the first source of power and illuminate when said control system determines that said second source of power is in an undervoltage, momentary outage or sustained outage condition;

wherein the control system is configured to:

determine whether said second source of power has voltage present;

if said second source of power does not have voltage present, then determining whether said first source of power is connected; and if said second source of power does not have voltage present and said first source of power is not connected, then preventing operation of said one or more first lighting elements when said first source of power is connected until said second source of power has a voltage present and said second source of power experiences an undervoltage, momentary outage or sustained outage condition, then said one or more first lighting elements receive power from the first source of power and illuminate.

2. The lighting fixture of claim 1, wherein said one or more first lighting elements comprise at least one LED.

3. The lighting fixture of claim 1, wherein said one or more second lighting elements comprise at least one HID lamp.

4. The lighting fixture of claim 3, wherein said at least one HID lamp is chosen from the group consisting of high-pressure sodium, mercury vapor and metal halide, or combinations thereof.

5. The lighting fixture of claim 1, wherein said one or more second lighting elements comprise at least one incandescent lamp.

6. The lighting fixture of claim 1, wherein said one or more second lighting elements comprise at least one fluorescent lamp.

7. The lighting fixture of claim 1 further comprising a heating element operably connected with said second source of power through said control system, wherein said control system thermostatically controls said heating element and said heating element provides heat to said first source of power allowing operation of said lighting fixture in ambient temperatures below 0 C.

8. The lighting fixture of claim 1 further comprising a test switch operably connected with said control system, wherein said test switch allows testing of the light fixture's operation.

9. The lighting fixture of claim 8, wherein the test switch causes operation of the one or more first lighting elements for a predetermined time period after test switch activation.

10. The lighting fixture of claim 8, wherein upon depression of the test switch in a defined sequence, the control system is configured to determine whether said second source of power has voltage present;

if said second source of power does not have voltage present, then determining whether said first source of power is connected; and if said second source of power does not have voltage present and said first source of power is not connected, then preventing operation of said one or more first lighting elements when said first source of power is connected until said second source of power has a voltage present and said second source of power experiences an undervoltage, momentary outage or sustained outage condition, then said one or more first lighting elements receive power from the first source of power and illuminate.

11. The lighting fixture of claim 1, wherein at least one of said one or more first lighting elements are tilted relative to a vertical axis passing through said lighting fixture such that light from said one or more first lighting elements is directed downward and outward from the lighting fixture.

12. The lighting fixture of claim 1, wherein the control system is configured to delay turning off said one or more first lighting elements receiving power from the first source of power after said second source of power is in a normal condition with power present.

13. The lighting fixture of claim 12, wherein the delay is 10 minutes.

14. The lighting fixture of claim 1, wherein the control system is configured to detect low-voltage of the first source of power and charge the first source of power if the second source of power is present, else disconnect the first source of power if the second source of power is not present.

15. The lighting fixture of claim 1, wherein the control system is configured to control the current from the first source of power proportional to the voltage of the first source of power when the ambient temperature is 0 C or lower.

16. A lighting fixture comprising:

one or more first lighting elements;

a first source of power, wherein said first source of power is a battery, and said battery is incorporated within or attached to said lighting fixture;

a control system that includes a microcontroller, wherein the one or more first lighting elements are configured to be controlled and operably connected to the first source of power by the control system;

one or more second lighting elements having a second source of power, wherein said one or more first lighting elements receive power from the first source of power and illuminate when said control system determines that said second source of power is in an undervoltage, momentary outage or sustained outage condition; and a test switch operably connected with the microcontroller, wherein operation of the test switch causes the microcontroller to determine whether said second source of power has voltage present;

if said second source of power does not have voltage present, then determining whether said first source of power is connected; and if said second source of power does not have voltage present and said first source of power is not connected, then preventing operation of said one or more first lighting elements when said first source of power is connected until said second source of power has a voltage present and said second source of power experiences an undervoltage, momentary outage or sustained outage condition, then said one or more first lighting elements receive power from the first source of power and illuminate.

17. The lighting fixture of claim 16, wherein operation of the test switch causes the microcontroller to operate of the one or more first lighting elements for a predetermined time period after test switch activation.

18. A method of providing emergency lighting comprising:

providing an emergency lighting fixture comprised of one or more first lighting elements and one or more second lighting elements, wherein the one or more first lighting elements are configured to be controlled and operably connected to a first source of power by a control system that includes a microcontroller and said one or more second lighting elements have a second source of power;

monitoring said second source of power with said control system to determine an undervoltage, momentary outage or sustained outage condition; and controlling the emergency lighting fixture such that said one or more first lighting elements are provided power from said first source of power when said second source of power enters an undervoltage, momentary outage or sustained outage condition; and if said second source of power enters an undervoltage, momentary outage or sustained outage condition, keeping said one or more first lighting elements illuminated until after said second source of power exits the undervoltage, momentary outage or sustained outage condition, or until said first source of power enters a power failure or undervoltage situation.

19. The method of claim 18, wherein providing an emergency lighting fixture comprised of one or more first lighting elements comprises providing at least one LED.

20. The method of claim 18, wherein providing an emergency lighting fixture comprised of one or more second lighting elements comprises providing at least one HID lamp.

21. The method of claim 20, wherein said at least one HID lamp is chosen from the group consisting of high-pressure sodium, mercury vapor and metal halide, or combinations thereof.

22. The method of claim 18, wherein providing an emergency lighting fixture comprised of one or more second lighting elements comprises providing at least one incandescent lamp.

23. The method of claim 18, wherein providing an emergency lighting fixture comprised of one or more second lighting elements comprises providing at least one fluorescent lamp.

24. The method of claim 18 further comprising providing a heating element operably connected with said second source of power through said control system, wherein said control system thermostatically controls said heating element and said heating element provides heat to said first source of power allowing operation of said lighting fixture in ambient temperatures below 0 C.

25. The method of claim 18, further comprising providing a test switch operably connected with said control system, wherein said test switch allows testing of the light fixture's operation.

26. The method of claim 18, wherein providing an emergency lighting fixture comprised of one or more first lighting elements comprises providing one or more first lighting elements that are tilted relative to a vertical axis passing through said lighting fixture such that light from said one or more first lighting elements is directed downward and outward from the lighting fixture.

27. The method of claim 18, further comprising:

determining whether said second source of power has voltage present;

if said second source of power does not have voltage present, then determining whether said first source of power is connected; and if said second source of power does not have voltage present and said first source of power is not connected, then preventing operation of said one or more first lighting elements when said first source of power is connected until said second source of power has a voltage present and said second source of power experiences an undervoltage, momentary outage or sustained outage condition, then said one or more first lighting elements receive power from the first source of power and illuminate.

* * * * *